US008276282B2

(12) United States Patent
Mainsonneuve et al.

(10) Patent No.: US 8,276,282 B2
(45) Date of Patent: Oct. 2, 2012

(54) AUTOMATIC BOW SIGHTING DEVICE WITH RANGE FINDING MEANS

(76) Inventors: Benoit Mainsonneuve, Val-Des-Monts, CA (US); Jacques Courville, Gatineau, CA (US)

( * ) Notice: Subject to any disclaimer, the term of this patent is extended or adjusted under 35 U.S.C. 154(b) by 0 days.

(21) Appl. No.: 13/114,175

(22) Filed: May 24, 2011

(65) Prior Publication Data

US 2011/0296699 A1 Dec. 8, 2011

Related U.S. Application Data

(60) Provisional application No. 61/350,946, filed on Jun. 3, 2010.

(51) Int. Cl.
*F41G 1/467* (2006.01)

(52) U.S. Cl. ..... 33/265; 124/87

(58) Field of Classification Search ..... 33/228, 33/265, DIG. 21
See application file for complete search history.

(56) References Cited

U.S. PATENT DOCUMENTS 3,766,656 A 10/1973 Westphal
3,910,700 A 10/1975 Sprandel
4,296,725 A * 10/1981 Broderick ..... 124/88
4,617,741 A * 10/1986 Bordeaux et al. ..... 33/228
4,953,302 A * 9/1990 Gould ..... 33/265
5,511,317 A 4/1996 Allen
5,575,072 A 11/1996 Eldridge
7,614,156 B1 11/2009 Imig
2009/0165314 A1* 7/2009 Khoshnood ..... 33/265
2010/0115778 A1* 5/2010 Gorsuch et al. ..... 33/265
2011/0271536 A1* 11/2011 Logsdon ..... 33/265
* cited by examiner

*Primary Examiner* — G. Bradley Bennett
(74) *Attorney, Agent, or Firm* — Daniel Boudwin; Alex Boyes

(57) ABSTRACT

Disclosed is an archery bow sighting device that incorporates a laser range finder, an automatically adjusting sight pin, trigger control and distance indicator. The device incorporates imbedded electronics and a gearing mechanism to adjust a sighting pin based on distance to target and calibrated distance data. The user aims the laser range finder at a designated target for determination of its distance, after which the sight pin is automatically adjusted to account for the distance and is used to aim at the target. To accurately aim the range finder, a peep sight along the length of the bow string is aligned with crosshairs within the range finder while aiming at the intended target. A trigger button along the bow pulses the laser range finder to determine distance, and the sighting pin elevation is updated accordingly by the imbedded electronic circuit and interpolation of preset distances. The device is attachable to any archery bow sight rail, and provides a means to quickly update a range to target if the target is mobile. A trigger button controls the device in use, while power is supplied by a user harnessed battery pack and wire tether.

3 Claims, 2 Drawing Sheets

AUTOMATIC BOW SIGHTING DEVICE WITH RANGE FINDING MEANS

CROSS REFERENCE TO RELATED APPLICATION

This application claims the benefit of U.S. Provisional Application No. 61/350,946 filed on Jun. 3, 2010, entitled "Automatic Sighter."

BACKGROUND OF THE INVENTION

1. Field of the Invention

The present invention relates to archery bow sighting devices. More specifically, the present invention pertains to an automatically adjusting archery sight device that responds to input from an imbedded laser range finding device for tracking mobile and long-distance targets. A singular sighting pin is provided along a motorized track. Input from the laser range finder updates the sighting pin elevation along its track and notifies the user of the target distance through a backward facing digital display. Input from the laser range finder and corresponding output to the sighting pin is controlled by an internal electronic circuit, which interpolates between preset distances determined when calibrating a given archery bow. Power for the device is fed from a battery pack tethered to the user to reduce bow weight and improve accuracy.

2. Description of the Prior Art

Archery hunting and long-distance archery aiming is a difficult task, even for seasoned archers. Arrow speed and adjustments for elevation drop over a long distance are difficult measures to estimate accurately. Incorrect aiming of an arrow upon release can lead to several unwanted consequences, including missing a target, wounding but not disabling a potential target animal, or finally hitting an unintended target altogether. None of these situations is desirable, especially considering the diligence and time required to locate a potential target.

Contemporary bow sights utilize a series of illuminated sighting pins vertically stacked within a sighting window to provide a user with the ability to adjust his or her aim for a calibrated distance. Each pin represents a different yardage marker, allowing the user to place a desired distance pin on the target while viewing through the sighting window. The pin provides a bow elevation adjustment, changing the trajectory of the arrow to account for longer or shorter distances to the target. These devices are useful, but are often cluttered with too much information. The sighting pins obscure a user's view of the target, while the distance is not always automatically calculated. The archer must estimate the distance and illuminate a pin that corresponds to that distance. This introduces two sources of error, one involving the distance estimation, and the second involving the user's memory with regard to which pin corresponds to a given distance.

Bow sights have been described in the art that incorporate laser range finding means coupled with contemporary archery sights. The range finding generally accompanies an electronic device that illuminates a given pin based on the target distance, or alternatively provides the user with a distance to manually adjust the sighting pins. While this improves the method of determining distance to a target and removes estimation errors, the use of multiple sighting pins or requiring a user to manually choose a calibrated pin based on a distance still involves a level of error that can be further eliminated with the present invention. Improper aiming of the range finder means while measuring the distance to target can also present errors. If the bow is aimed from a different position or orientation than that of the firing position, or if the archer is positioned in a different stance when utilizing the range finding means, the distance to target may be in error. The distance prior to release may be different than the distance determined by the range finder. This error is also addressed in the present invention, wherein a laser range finder aiming reticle and peep sight are provided that allow accurate alignment of the bow to the target in a firing position, and accurate distance determination thereof.

Devices have also been disclosed in the prior art that describe combination laser sighting devices and adjustable sighting means. These include mechanically motorized sights, illuminating digital screens and optical displays that show a target and an arrow impact location given its trajectory and release velocity. These devices share a common drawback in that their laser sighting means is not guaranteed to be aligned with the arrow trajectory prior to release. An individual sighting pin is also not provided that automatically updates its position based on laser range finder input. The present invention utilizes this input, and input from the user when the bow is calibrated, to interpolate between calibrated distances and determine the most accurate sighting pin position for a given distance, determined by the laser range finder.

Patents have been published that disclose similar bow mounted sighting devices. These include both automatic and non-automatically adjusting sights based on distance to a target. U.S. Pat. No. 3,766,656 to Westphal is one such device, wherein an adjustable sight pin is provided when the bow is drawn. An electrical switch accessible by the archer energizes a motor that drives a sighting pin along a screw device, updating its position based on distance and anticipated arrow trajectory. The movement of the sighting pin is manually controlled by the user during the aiming process, without any distance measurement means or automatic adjustment resulting therefrom. This device is useful for updating a bow sight while the bow is drawn, but it relies heavily on user ability and judgment to produce an accurate shot.

U.S. Pat. No. 5,511,317 to Allen is a similar bow sight device in which the user may manually adjust the sight based on distance to a target. The sighting element may be displaced in height to adjust the orientation of the arrow trajectory and subsequent impact location. The adjustment is achieved by a rotary mechanism, controlled by the archer's bow hand while the string is drawn. Similar to the Westphal patent, this mechanism has no means to measure the range to target or automatically adjust the sight mechanism based on those measurements. This device similarly introduces greater risk of misjudging the distance and missing the target altogether, as opposed to the present invention, wherein distance to target is measured and the sight is automatically adjusted accordingly. The chances of wounding but not harvesting a target animal are reduced with the present invention.

U.S. Pat. No. 3,910,700 Sprandel describes a motorized sight and range finder for an archery bow, wherein a vertical slide enables vertical movement of a sight bar for placement on a target and adjustment thereof to account for distance and arrow drop. A gear train, electric motor and a series of linkages provides actuation of the sight bar along the vertical slide. As with the aforementioned patent, no laser range finding means or method of automatically adjusting the sight is provided. This sight also provides a larger, more obtrusive mechanism for adjusting the sighting pin. The linkages block the view of the archer while in use, as opposed to the internal structure and mechanisms utilized in the present invention.

U.S. Pat. No. 7,614,156 to Imig describes a bow-mounted sight unit with a range finder and optical sight. Cross-hairs on the optical sight are adjusted based on input from the laser range finder and historical data stored in a data storage unit for arrow drop over a distance for a specific bow. The cross-hairs update on the optical sight based on these inputs and control via a microprocessor, allowing compensation for long distances and accurate measurement thereof. This device provides a digital indication of the arrow impact location, as opposed to a physical sighting pin that adjusts position based on input from a laser range finding device and onboard electronics.

U.S. Pat. No. 5,575,072 to Eldridge describes an archery sight targeting and range finding device that provides a transparent window with sight markers and a digital distance indicator. The sight operates in conjunction with a range finding device to determine a distance to a destined target, automatically updates the sighting marks on the display and notifies the user of the marker distance. Imbedded electronics and a defined algorithm are provided to control the automatic adjustment of the range markers. While this device provides automatic adjustment of the sight markers, it provides it in a sufficiently different structure than the present invention. The method of aligning the sight targeting marker with the range finder marker also differs from the present invention method of aligning the range finder to the target, and the arrow trajectory thereof.

Bow and archery sight devices are well described in the art. These contain varying features and levels of sophistication with regard to range finding and sight adjustment. The present invention provides a robust, error-proof device that accurately measures a distance to a target, compensates the sighting pin for that distance, and alerts the user when ready to fire. The adjustment provides a calculated initial arrow inclination given an arrow's initial velocity and gravity over the distance to the intended target. In this way, the arrow trajectory is modified to yield a desired impact location. The present invention is a simple electromechanical device, provides a clear field of view for the user, and ensures the measured range is accurate when releasing the arrow towards a downfield target. It substantially diverges in design elements from the prior art and consequently it is clear that there is a unmet need in the art for an improvement to existing bow sight devices with automatically adjusting sight means and range finding means. In this regard the instant invention substantially fulfills these needs.

SUMMARY OF THE INVENTION

In view of the foregoing disadvantages inherent in the known types of bow sight devices now present in the prior art, the present invention provides a new bow sight device wherein the same can be utilized for providing convenience for the user when determining the appropriate inclination of the bow prior to arrow releast based on an automatically adjusting a sighting pin that uses calibrated data and a laser range finding means to determine the appropriate distance to target and the sighting pin elevation therefor.

The present invention fulfills a need in the art by providing a compact sighting device that includes a range finding means, an electronic controller, and a gearing mechanism for automatically updating the vertical position of a sighting pin given a designated target distance. The elevation of the sighting pin allows the user to adjust the trajectory of the arrow by adding inclination to the initial arrow release vector. The range finding means determines the distance to a target and the onboard microprocessor interpolates between calibrated preset distances for a given bow. Internal circuit logic and programming of a microprocessor automates the sightin pin vertical position by based on the range finder input and comparing with historically stored data relating to the present bow. The initial velocity of the arrow and the drop over a given distance is compared to the measured distance to ensure the sighting pin is aligned in such a manner as to allow the arrow to impact a desired target, particularly at long ranges.

An internal electric motor and gearing mechanism provides the motive force and means to translate the sighting pin based on range finder input. A rear-facing display alerts the user of the measured distance, while a push button attached to the bow allows the user to pulse the range finder means when aiming at the target. To ensure proper alignment of the sighting device with the intended target, and therefore ensure an accurate distance is calculated, a peep sight in-line with the bow string provides a tool to align the bow and range finding means with the intended target. Once the sighting pin is adjusted, the bow is inclined or declined as required before release.

The present invention serves several functions, namely to provide an automatic means of sighting adjustment and to improve the accuracy of long-distance archery shots. This is particularly useful for hunters, as wounded animals may not be harvested, and misguided arrows may squander a precious opportunity.

It is therefore an object of the present invention to provide an archery sighting device that integrates a laser range finding means to determine a distance to target and to automatically adjust a sighting pin for that distance.

Another object of the present invention is to remove errors associated range estimation and preset distance memorization while aiming at a target and preparing to release an arrow.

Yet another object of the present invention is to provide a sighting device that determines the range to target after a user has retracted the bow and designated a target by aligning a peep sight with the range finder reticle, providing accurate measurements from a firing position.

It is also an object of the present invention to provide a new and improved bow sighting device that has all of the advantages of the prior art and none of the disadvantages.

Other objects, features and advantages of the present invention will become apparent from the following detailed description taken in conjunction with the accompanying drawings.

BRIEF DESCRIPTIONS OF THE DRAWINGS

DETAILED DESCRIPTION OF THE INVENTION

Figure 1:
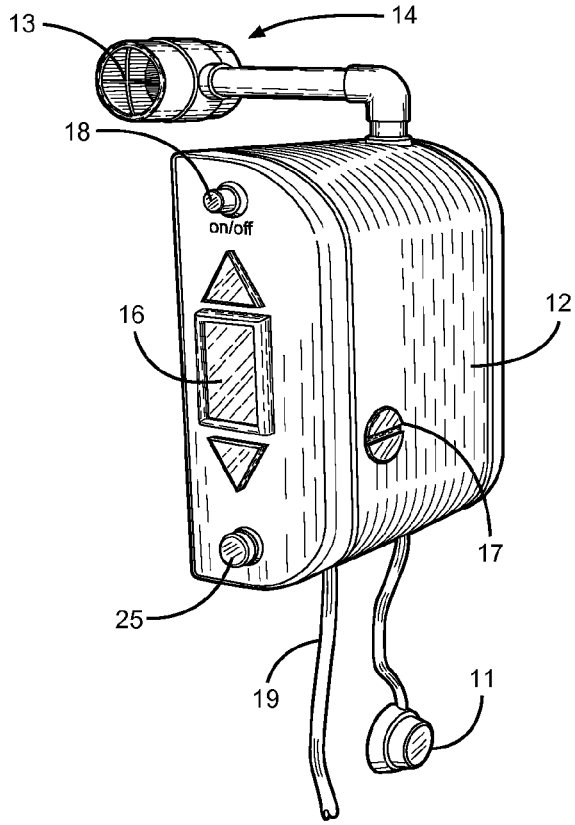
FIG. 1 shows a rear perspective view of the present invention.

Referring now to FIG. 1, there is shown a rear perspective view of the present invention. The device comprises sighting device housing 12, which provides enclosure for imbedded electronics and mechanical gearing, along with support for external accessories and attachments to an archery bow. Along the backside of the housing 12 is a user-facing display 16, a power button 18 and fire-ready indicator light 25. The display is a digital interface for the user to reference a target distance, measured by an imbedded laser range finding means. The display provides a read-out for the user, noting a numerical distance in yards for which the sighting pin elevation is positioned. This provides the user with a quick reference with regard to the measured distance, without reliance on memory or requiring the user to alter his or her vision while retracting the bow.

Above and below the display 17 are and up arrow and down arrow buttons. These buttons allow the user to program the preset distances when calibrating the unit. Every archery bow has its own characteristics, including initial arrow velocity that can change its elevation drop over a given distance. When calibrating the present invention for a given bow, the arrow buttons are used to toggle through different distance markers (i.e. 15, 30, 45 yards, etc). For a given distance, the turn screw is used to make incremental changes to the sighting pin elevation to allow for the correct bow orientation to allow for an accurate strike at the given distance. Therefore, when a user utilizes the range finding means in the field, the onboard microprocessor can interpolate distances between the preset, pre-calibrated distances.

A finger trigger button 11 is wired into the housing 12 and integrated into the internal electronics of the device. The trigger 11 runs from the housing 12 and attaches to the user's archery bow in a position on the bow grip that will allow the user's index finger to depress the trigger 11 while grasping the bow and while retracting the arrow into a firing position. The trigger 11 is a user interface that registers depressions and updates the sighting pin and display distance. A single depression of the trigger 11 pulses the range finder and records the measured distance, while two sequential depressions resets the sighting device to a default position. Once the trigger 11 is depressed a single time, the range is measured, the display 16 is updated with the measured yardage and the sighting pin is moved along a vertical path to provide the user with an appropriate reticle to place on the target that will account for elevation drop of the arrow over the measured distance. When the sighting pin is located correctly and the arrow is ready to be fired, a small indicator light 25 will illuminate to notify the user that the sighting pin is locked into the correct position given the target distance, and that the arrow may be fired when ready.

Along the top surface of the housing 12 is a laser range finder aiming sight 14. This sight 14 aligns the aim of the bow with the orientation of the laser range finding means, and allows the user to accurately place the target in the path of the laser. The sight 14 provides a means for the user to accurately aim the laser range finder at the desired target, designate and calculate range to that target. The sight 14 provides a cross-hair reticle that may be aligned with a peep sight provided in-line with the bow string. The user draws the bow string into a firing position, looks through the peep sight and aligns the peep sight with the reticle 13 of the range finder sight 14. The aligned sights are then used to orient the bow into a position to place reticles onto the target. This procedure reduces any error associated with measuring the target distance based on the aim of the laser range finding means, ensuring that the most accurate distance measurement is provided for the user and for the electronics to receive as input for updating the elevation of the sighting pin.

Along with control mechanisms and accessory attachment on the exterior of the housing 12, several structural and electrical components are also present. These include a set of bow attachment fasteners that affix the device to the bow along an interface defined by the inside surface of the housing and the bow sighting rail, an electrical power button 18 and an elongated power cord 19. The bow attachment fasteners attach the device to a bow along the sighting rail, similar to the method employed by standard archery bow sights. This fastened joint must possess substantial structural clamping force to resist motion of the housing 12, and therefore misalignments of the laser range finding sight and sighting pin. The screws must also remain in position after an arrow has been released, which creates a rapid dissipation of potential energy that sends considerable load and vibration through the bow and into the connection between the housing 12 and the bow sight shelf. To this end, the fasteners are comprised a high stiffness material that can retain the housing position in use.

Electrical function of the present invention is provided by a power button 18 on the backside of the housing 12. Depression of the power button closes an electrical switch that allows transfer of power from a battery power source to the electrical circuit and microprocessor unit. The battery power source is physically carried by the user in a remote battery pack. The battery pack may be housed in an enclosure that allows the user to store the batteries in his or her jacket. This serves two protective functions: first, the battery pack is protected from cold weather conditions by being stored in a sheltered position and close to the user's body heat, and secondly the battery pack and electrical leads therefrom are protected from the shock environment of the bow as it is fired. This also reduces the weight of the housing 12, reducing the weight of the bow itself, which is held in an extended position by the user's arms and produces considerable strain on the user in use. The lighter the sighting device, and the lighter the bow, the easier it is for the user to consistently aim at a target and draw the bow into a firing position. Connection between the battery pack and the housing 12 is provided by an elongated electrical cord 19, which connects to the base of the housing 12 and into the electronics within the same.

Figure 2:
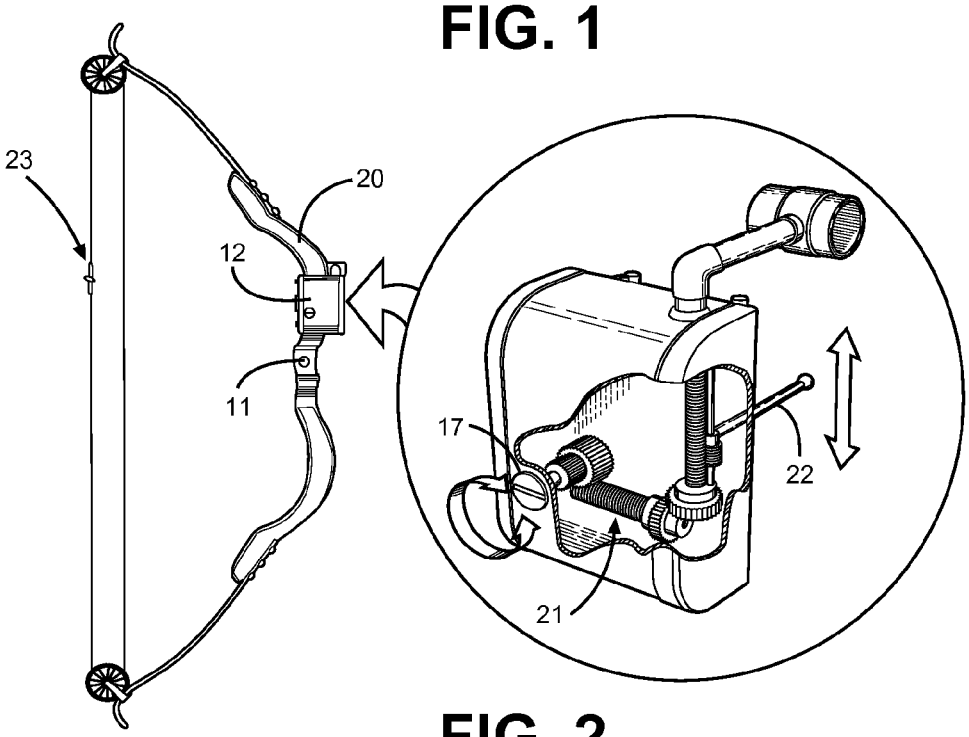
FIG. 2 shows a side view of the present invention attached to a sighting rail of an archery bow, as well as a close-up perspective view of the present invention and illustration of the internal gearing structure.

Referring now to FIG. 2, there is shown a side view of the present invention housing 12 in its intended location on the sighting post 20 of an archery bow. The housing 12 is positioned above the hand grip position on the bow, in the traditional location for an archery sighting device. The trigger button 11 is mounted in a position such that the user may easily toggle the trigger while the bow is in a firing position and aimed at a down-range target. The peep sight 23 provided for aligning the laser range finding means is placed in-line with the bow string, allowing the user to align the user's eye with the peep sight, laser sight and the target, with the goal of properly aligning the laser range finder on the down range target, and subsequently measuring an accuract distance thereto.

A close-up perspective view of the present invention is also provided in FIG. 2, including an internal cut-away view of the gearing mechanism 21 used to adjust the vertical position of the sighting pin 22. The sighting pin 22 traverses a vertical path based on input from the laser range finding means and corresponds to the calibration input from the user via preset distances and incremental positions therebetween.

An imbedded set of electronics (not shown) that includes a microprocessor and necessary electrical components provides input and output for the present invention to allow automatic repositioning of the sighting pin 22 along its vertical path. Input is taken from the laser range finding means, which pulses a laser towards a target and measures the time for the reflected pulse to arrive at the finder means. The measured time provides the device with a way of calculating the distance to target, and therefore providing an input for the microprocessor to reposition the sighting pin 22. Repositioning is possible by output signals sent to an electrical motor, which rotates a gearing mechanism that repositions the sighting pin 22 along its vertical path. The positioning of the sighting pin 22 is based on calibrated data for preset distances on a given bow. Laser range finder measurements in between preset distances are interpolated to determine an appropriate pin 22 based on that measured distance.

Figure 3:
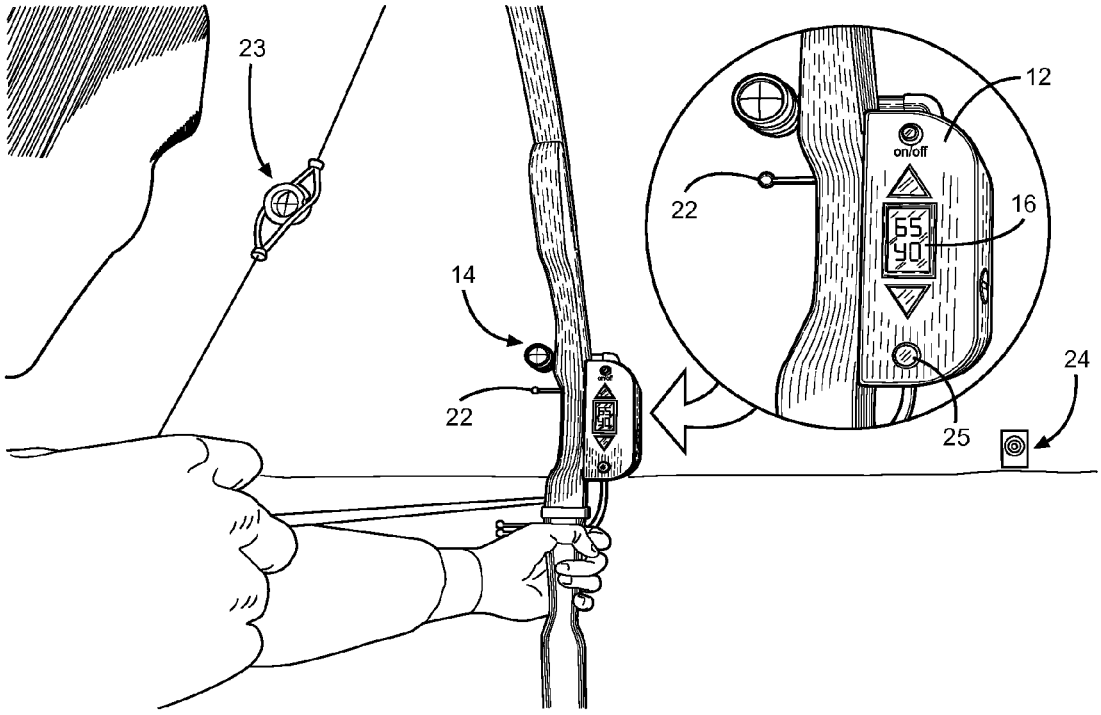
FIG. 3 shows a view of the present invention in its working position, wherein a user is aligning a peep sight with the range finding means prior to the sighting pin adjustment.

Referring now to FIG. 3, there is shown a view of the present invention in its working position. A user is utilizing the device to accurately determine the distance to a target 24 and aim accordingly. After the device has been turned on, the user draws the bow string and arrow into a firing position. He then aligns the peep sight 23 within the string with the laser range finder sight 14 and the down-range target 24. The laser range finder is now properly aimed at the target and ready to measure its distance. The user depresses the trigger button once with his index finger to pulse the range finder. The distance is then measured and communicated to the microprocessor for further action. The microprocessor directs an electric motor and gearing mechanism to reposition the sighting pin into a position that changes the inclination of the bow to allow an initial trajectory of the arrow to permit the arrow to land on the target at a desired location after traveling a given distance. The range is indicated to the user in the display window 15 on the backside of the housing 12. After the sighting pin is in a position corresponding to the target distance, the fire-ready light 25 illuminates to notify the user that the target is acquired and the sighting pin is positioned. The user then places the sighting pin on the downrange target and releases the arrow when ready.

The internal components of the present invention may be packaged and oriented to reduce overall mass and to permit efficient functionality. The imbedded electronics, electric motor, gearing mechanism and laser range finding means are all placed within the cavity of the housing 12. The laser range finding means is imbedded in the device housing 12 in a way to align the range finder sight with its laser direction. Output from the laser pulses outward from a window along the frontside of the housing 12 and towards the intended target.

The goal of the present invention is to improve current archery sights, and to provide an improved means of aligning the range finding means with the target prior to releasing an arrow. Once the sighting pin has been dialed into the given target based on the measured distance, missed targets and wounded but not harvested animals are reduced. The automatic movement of the sighting pin allows the user to adjust the position of the sighting pin in the event of a moving target. Updates may be made by depressing the trigger and updating the sighting pin location for a new distance. This is accomplished all while the archer is placing the arrow in a firing position, providing rapid alignment and updating of the sighting device. The updated position provides the user with input for changing the trajectory of the arrow to account for arrow drop over the distance to the target.

With respect to the present invention and its relation to the prior art, the present invention is an improvement in the sighting means and methods for aligning the range means while targeting an archery bow, particularly over long ranges or with moving targets that are continually changing their distance to the user. The device is compact, light weight and accommodates any type of bow with adequate position for a sighting device. The calibration of the sighting device is accomplished for each specific bow to be used in coordination with the device, as initial velocities of each bow are individually characteristic and different from bow to bow. Calibration and storage of historical distances are stored on a programmable map within the imbedded set of the electronics, and referenced when input is received from the laser range finding means for interpolating or extrapolating from the calibrated distances.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

We claim:

1. An automatically adjusting archery sighting device for accurately calculating a range to target and adjusting a sighting means, comprising:

an electronic sighting enclosure with an open interior and attachment means for placement on an archery bow sight rail, a microprocessor and electric circuit, electric motor, gearing mechanism and laser range finding means stored within said open interior, a distance display, preset yardage arrow buttons, power switch and fire-ready indicator on a rear surface of said sighting enclosure, a laser range finder sight along a top surface of said sighting enclosure comprising a sighting reticle aligned with said laser range finder, a sighting pin extending perpendicularly from a side surface of said sighting enclosure, a turn screw device for adjusting said sighting pin while calibrating said archery bow for preset distances, a trigger button wired into said electric circuit and attachable to said archery bow for pulsing said laser range finder, a power cord wired from said electrical circuit to an external battery pack, the vertical position of said sighting pin automatically translated based on input from said range finder means and microprocessor control of said electric motor and said gearing mechanism based on historical calibration data for said archery bow and interpolation or extrapolation thereof, a peep sight in-line with a string of said archery bow for aligning said laser range finding means with a target.

2. A device as in claim 1, wherein said external battery pack is carried by a user and not structurally connected to said archery bow.

3. A method of aligning laser range finding means of an archery bow sight with a target and automatically adjusting sighting means, comprising aligning a peep sight in-line with an archery bow string with a sight aligned with a laser range finding means, placing said aligned sights onto a target, pulsing said laser range finding means to determine range to target, receiving input from said pulse and said range to target to automatically translate a sighting pin along a vertical path to account for arrow drop over said determined distance, placing sighting pin on target and releasing said arrow.

* * * * *